US012492068B2

(12) United States Patent
Benzick

(10) Patent No.: US 12,492,068 B2
(45) Date of Patent: Dec. 9, 2025

(54) FLOWER HYDRATING TRANSPORT POUCH DEVICE

(71) Applicant: John William Benzick, Excelsior, MN (US)

(72) Inventor: John William Benzick, Excelsior, MN (US)

( * ) Notice: Subject to any disclaimer, the term of this patent is extended or adjusted under 35 U.S.C. 154(b) by 379 days.

(21) Appl. No.: 17/867,569

(22) Filed: Jul. 18, 2022

(65) Prior Publication Data

US 2023/0166903 A1 Jun. 1, 2023

Related U.S. Application Data

(60) Provisional application No. 63/361,139, filed on Nov. 29, 2021.

(51) Int. Cl.

| | |
|---|---|
| ***B65D 85/50*** | (2006.01) |
| ***B65D 75/56*** | (2006.01) |
| ***B65D 75/58*** | (2006.01) |
| ***B65D 81/22*** | (2006.01) |

(52) U.S. Cl.

CPC ..... *B65D 85/505* (2013.01); *B65D 75/563* (2013.01); *B65D 75/566* (2013.01); *B65D 75/5805* (2013.01); *B65D 81/22* (2013.01)

(58) Field of Classification Search

CPC .. B65D 85/505; B65D 75/563; B65D 75/566; B65D 75/5805; B65D 81/22

USPC ..... 224/148.1, 572

See application file for complete search history.

(56) References Cited

U.S. PATENT DOCUMENTS

| | | | | |
|---|---|---|---|---|
| 4,209,032 | A | 6/1980 | Jones | |
| 4,910,913 | A | 3/1990 | Streeter | |
| 5,167,354 | A * | 12/1992 | Cohanfard | A47G 19/2266 215/229 |
| 5,413,261 | A * | 5/1995 | Wu | A47J 41/0083 215/396 |
| 5,505,353 | A * | 4/1996 | Marsh, Jr. | A45F 5/00 224/602 |
| 5,566,869 | A * | 10/1996 | Katz | A45F 3/16 224/267 |
| 5,687,503 | A | 11/1997 | D'Costa | |
| 5,715,944 | A * | 2/1998 | Windisch | A47G 7/063 47/84 |
| 5,913,463 | A * | 6/1999 | Carr | A45F 5/00 224/148.1 |
| 6,076,967 | A * | 6/2000 | Beaudette | B65D 75/008 383/41 |
| 6,561,353 | B2 | 5/2003 | Levieux | |
| 7,036,271 | B2 | 5/2006 | Hjorth | |
| 7,073,290 | B2 | 7/2006 | Weder | |
| 7,322,476 | B2 * | 1/2008 | Witherspoon | A63B 47/00 206/579 |

(Continued)

*Primary Examiner* — Peter N Helvey

(57) ABSTRACT

A flower hydrating transport pouch device for cost efficiently preserving fresh cut flowers during transport from a point of sale includes a pouch defining an interior space. The pouch has a pair of lateral sides and an upper edge. The upper edge is removable from a body of the pouch to expose an opening into the interior space. A hydrating fluid is in the interior space. A closure is positioned on the body of the pouch adjacent to the opening for selectively closing the opening. A tether line extends from the pouch for engaging interior structure of a vehicle for transporting flowers having stems extending into the hydrating fluid within the interior space of the pouch.

16 Claims, 5 Drawing Sheets

(56) References Cited

U.S. PATENT DOCUMENTS 8,444,021 B1 * 5/2013 Ferreiro ..... A45F 3/20 224/148.2
8,523,440 B2 * 9/2013 Walker ..... B65D 33/24 383/203
10,479,548 B2 11/2019 Okude
D874,876 S * 2/2020 Finell ..... D7/602
11,116,142 B2 9/2021 Wiggers
11,253,433 B2 * 2/2022 Davis ..... A61J 9/0638
D945,826 S * 3/2022 Finell ..... D7/509
D950,393 S * 5/2022 Johnson ..... D9/707
2003/0070358 A1 * 4/2003 Weder ..... B31F 1/0045 47/72
2003/0173245 A1 * 9/2003 Story ..... A01N 3/02 206/423
2006/0060486 A1 * 3/2006 Castleberry ..... A01G 24/48 206/423
2006/0265950 A1 * 11/2006 Castleberry ..... A01G 24/48 47/41.01
2007/0028515 A1 * 2/2007 Vespa ..... B65D 85/505 47/58.1 R
2008/0193058 A1 8/2008 Rothstein
2008/0202025 A1 * 8/2008 Temkin ..... A47G 7/063 248/346.03
2008/0230409 A1 * 9/2008 Elfezouaty ..... A47G 7/063 705/26.1
2008/0233252 A1 * 9/2008 Manning ..... B65D 33/2508 426/106
2009/0038218 A1 * 2/2009 Weder ..... B65D 5/50 47/72
2009/0180718 A1 7/2009 Walker
2009/0211153 A1 * 8/2009 Harshman ..... B65D 85/505 47/66.7
2011/0249919 A1 * 10/2011 Shepard ..... B65D 75/008 383/203
2014/0254956 A1 * 9/2014 Buell, III ..... A45F 3/04 383/88
2015/0136627 A1 * 5/2015 Sabogal ..... B65D 85/52 206/423
2016/0192596 A1 * 7/2016 Demarse ..... B65D 85/505 428/80
2018/0339540 A1 * 11/2018 Barnhardt ..... B42D 15/027
2023/0086124 A1 * 3/2023 Kominami ..... B65B 51/04 222/107
2023/0086780 A1 * 3/2023 Furuya ..... B65D 35/02 383/9
2023/0166903 A1 6/2023 Benzick

* cited by examiner

FLOWER HYDRATING TRANSPORT POUCH DEVICE

CROSS-REFERENCE TO RELATED APPLICATIONS

I hereby claim the benefit under 35 U.S.C. Section 119(e) of U.S. Provisional application 63/361,139 filed Nov. 29, 2021.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to fluid holding pouch devices and more particularly pertains to a new fluid holding pouch device for cost efficiently preserving fresh cut flowers during transport from a point of sale.

(2) Description of Related Art including information disclosed under 37 CFR 1.97 and 1.98

The prior art relates to fluid holding pouch devices. Known prior art lacks a self contained receptacle to resist tipping during transport which is also cost efficient for preserving fresh cut flowers during transport from a point of sale.

BRIEF SUMMARY OF THE INVENTION

An embodiment of the disclosure meets the needs presented above by generally comprising a pouch defining an interior space. The pouch has a pair of lateral sides and an upper edge. The upper edge is removable from a body of the pouch to expose an opening into the interior space. A hydrating fluid is in the interior space. A closure is positioned on the body of the pouch adjacent to the opening for selectively closing the opening. A tether line extends from the pouch for engaging interior structure of a vehicle for transporting flowers having stems extending into the hydrating fluid within the interior space of the pouch.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
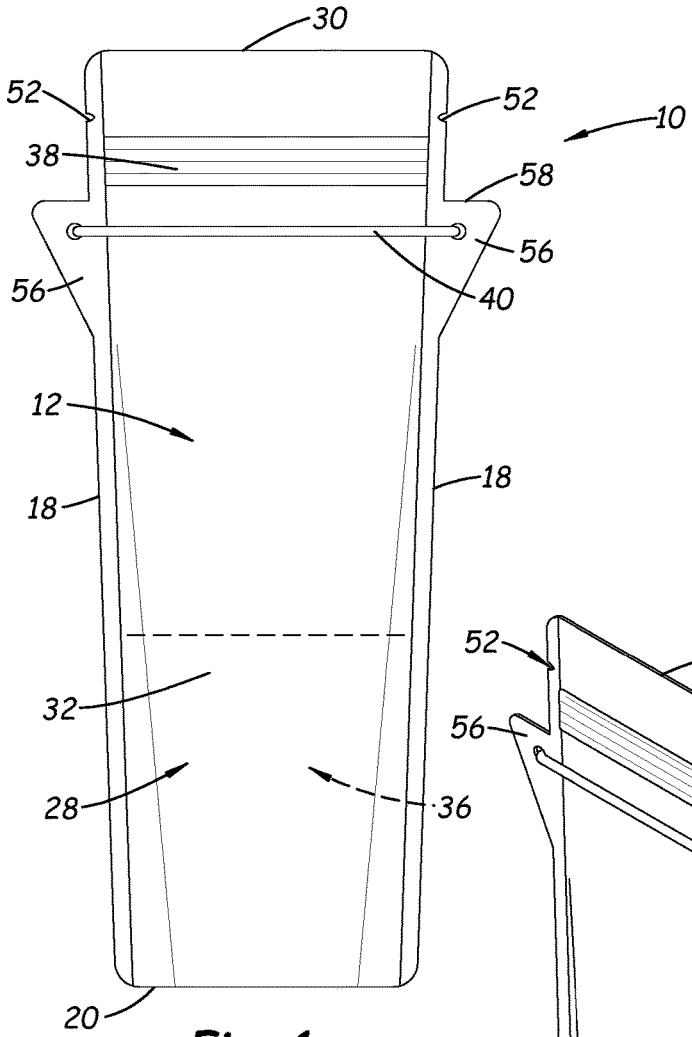
FIG. 1 is a front view of a flower hydrating transport pouch device according to an embodiment of the disclosure.
Figure 2:
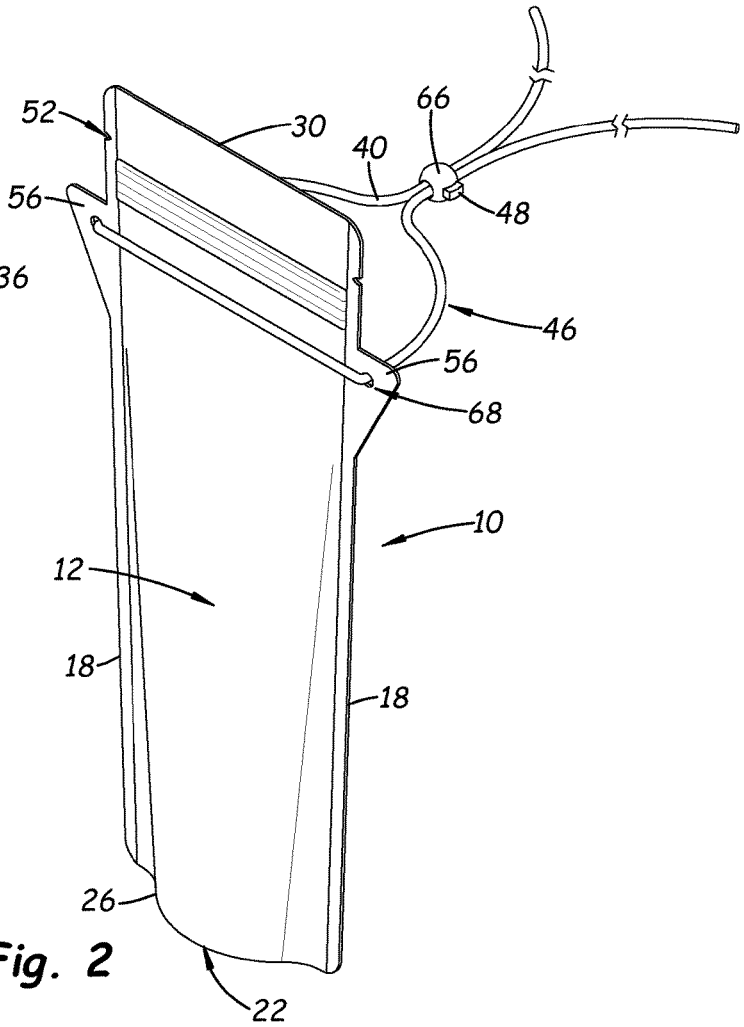
FIG. 2 is a top front side perspective view of an embodiment of the disclosure.
Figure 3:
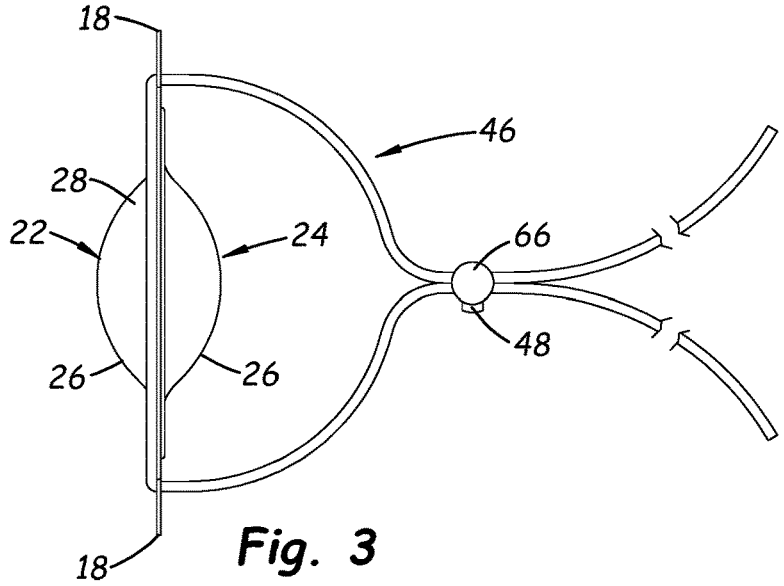
FIG. 3 is a top view of an embodiment of the disclosure.
Figure 4:
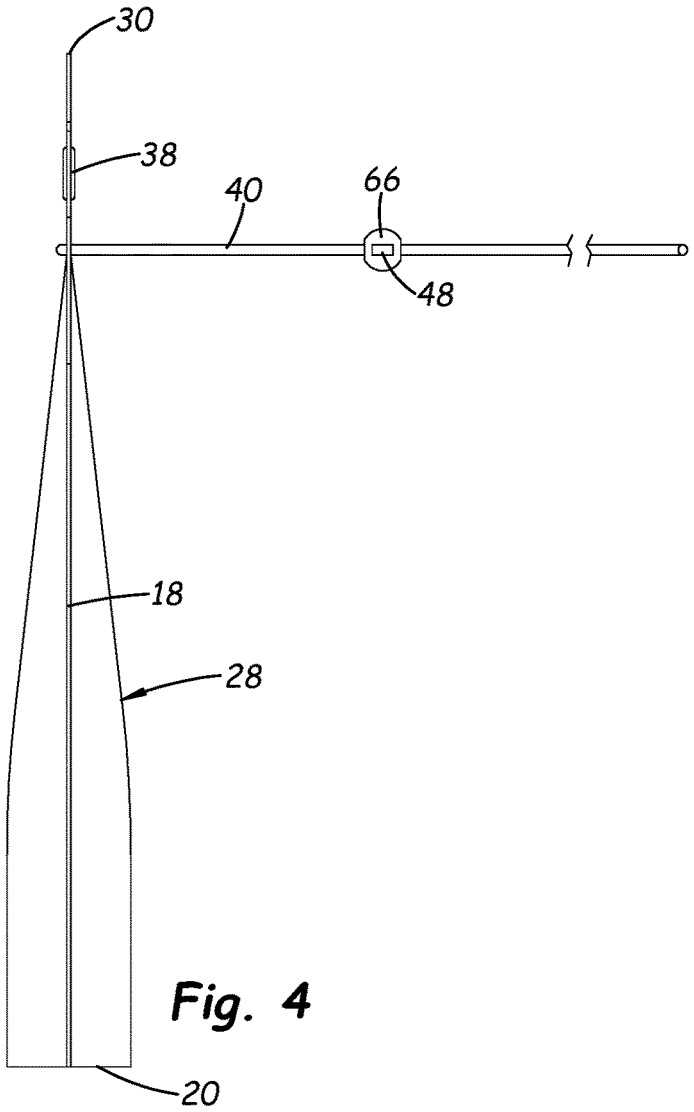
FIG. 4 is a side view of an embodiment of the disclosure.
Figure 5:
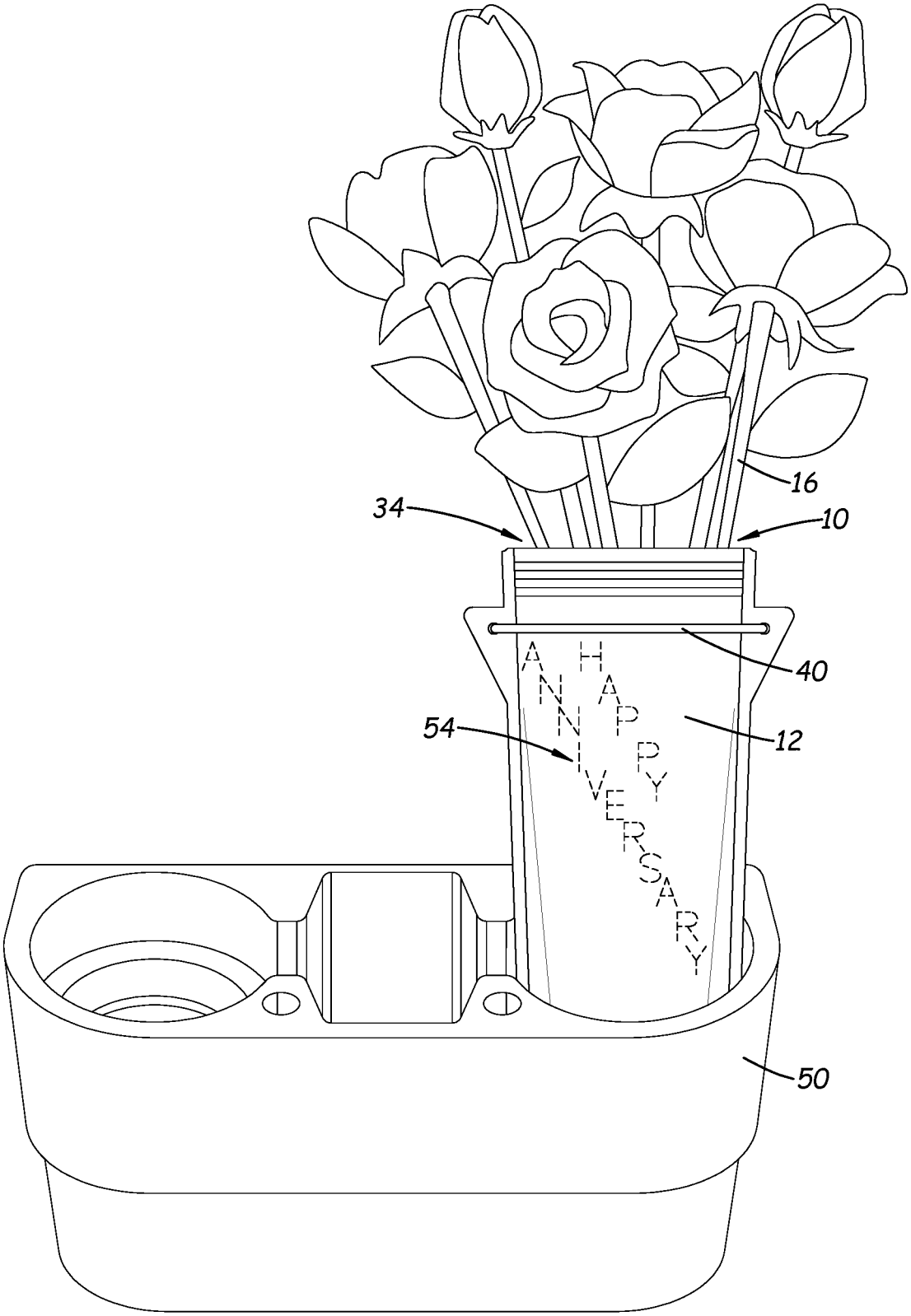
FIG. 5 is a front view of an embodiment of the disclosure in use.
Figure 6:
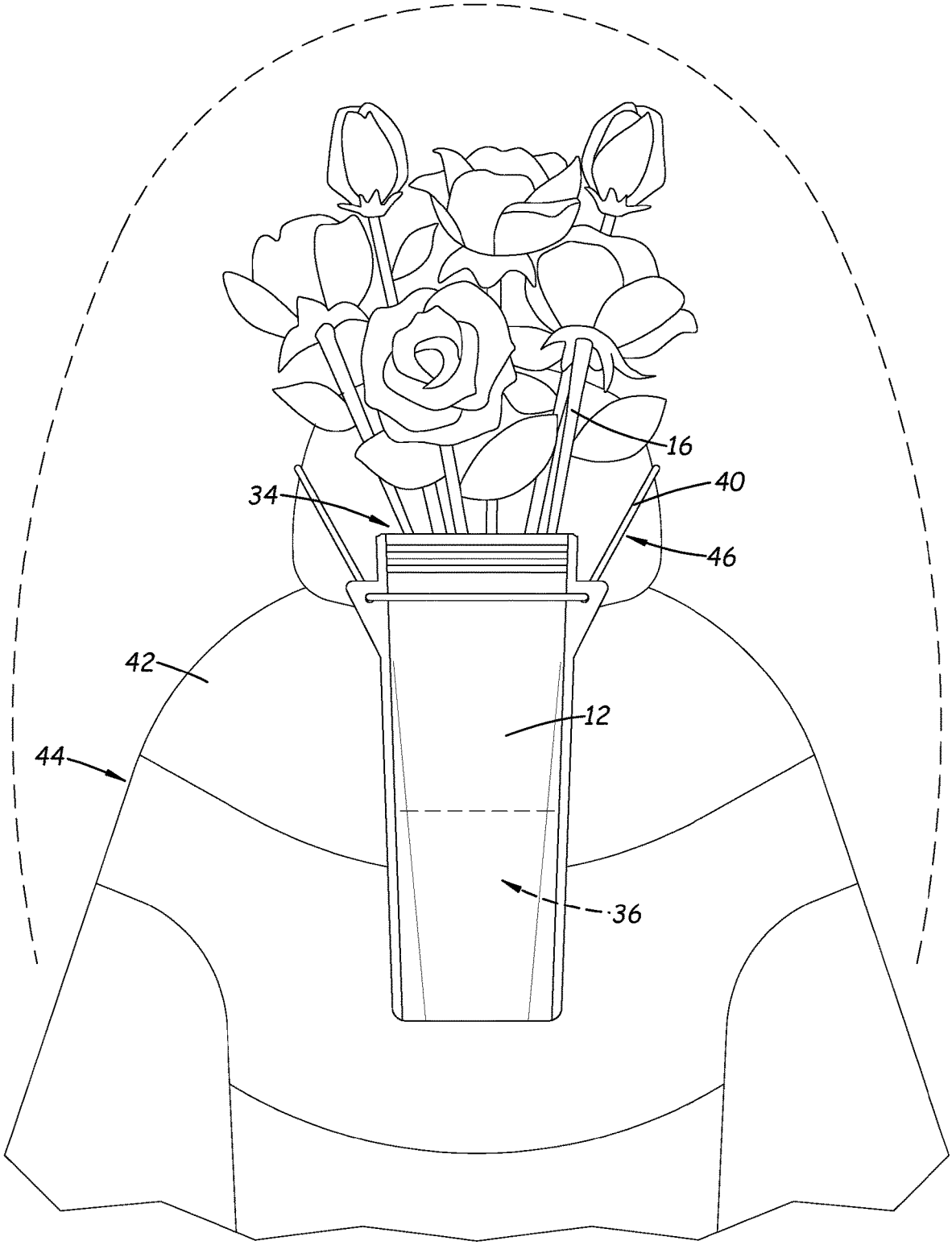
FIG. 6 is a front view of an embodiment of the disclosure in use.

With reference now to the drawings, and in particular to FIGS. 1 through 8 thereof, a new fluid holding pouch device embodying the principles and concepts of an embodiment of the disclosure and generally designated by the reference numeral 10 will be described.

As best illustrated in FIGS. 1 through 8, the flower hydrating transport pouch device 10 generally comprises a pouch 12. The pouch 12 defines an interior space 14 to receive and hold fresh cut flowers 16. The pouch can be made of polyethylene terephthalate (PET), polyethylene (PE), and an extruded film made from polypropylene (MOPP). The pouch 12 has a pair of lateral sides 18. The pouch 12 has a bottom side 20. The bottom side 20 is planar wherein the pouch 12 is configured for standing upright on a support surface such as the bottom of a cup holder in a vehicle or any other substantially horizontal surface. The bottom side 20 has a front edge 22 and a rear edge 24.

Respective medial sections 26 of the front edge 22 and the rear edge 24 are covexly arcuate. The pouch 12 is generally symmetrical such that determination of the front edge 22 and rear edge 24 are mirror images of each other. The pouch 12 has a medial portion 28 between the lateral sides 18. The medial portion 28 extends upwardly from the medial sections 26 of the front edge 22 and the rear edge 24. The medial portion 28 flares outwardly extending away from the bottom side 20 of the pouch 12.

An upper edge 30 of the pouch 12 is removable from a body 32 of the pouch 12 to expose an opening 34 into the interior space 14. A hydrating fluid 36 is positioned in the interior space 14 and enclosed within the pouch 12 prior to removal of the upper edge 30. The hydrating fluid 36 may be water alone or a mixture of water and plant nutrients dissolved into water. It is contemplated the plant nutrients would be those known to persons skilled in the art and currently provided in a packet at the time of purchase for addition to water when placing fresh cut flowers into a vase or other receptacle at a final display destination.

A closure 38 is coupled to the pouch 12. The closure 38 may be a zipper resealable press to seal closure. The closure 38 is positioned on the body 32 of the pouch 12 adjacent to the opening 34. The closure 38 selectively closes the opening 34 when desired. The closure 38 may be provided with a conventional enhanced seal holding the closure in a sealed condition until after the upper edge 30 is removed and a user initially opens the closure 38.

A tether line 40 is coupled to the pouch 12 facilitating holding of the pouch 12 in an upright position to inhibit tipping or spillage. The tether line 40 extends from the pouch 12 such that the tether line 40 is configured for engaging interior structure 42 of a vehicle 44. Thus, the pouch 12 is configured for transporting flowers having stems extending into the hydrating fluid 36 within the interior space 14 of the pouch 12. A toggle 66 may be coupled to the tether line 40 wherein the toggle 66 is configured for forming the tether line 40 into an adjustable sized loop 46 extending from the pouch 12. Thus, the tether line 40 can be used to hang the pouch 12 from a seat back, hook, or similar structure in the vehicle 44. The toggle 66 has a locking element 48 biased into engagement with the tether line 40 for fixing a position of the toggle 66 on the tether line 40. The locking element 48 is manipulatable to release the locking element 48 from the tether line 40 for adjustment of a position of the toggle 66 on the tether line 40. Alternatively, the tether line 40 may also be simply tied into a loop or otherwise secured by a clip or other binder sufficient to hold the tether line 40 in the loop 46 without becoming disengaged from the interior structure 42 of the vehicle 44. It is also contemplated that the tether line 40 may be used to hang or engage the pouch 12 to any supporting structure other than inside the vehicle 44 if so desired. The pouch 12 is also sized similar to conventional sizes of travel cups or bottles to be positionable within a cup holder 50 in the vehicle 44. It is also contemplated that the tether line 40 may be formed integrally with the structure of the pouch 12 and set off by perforations to allow for the tether line 40 to be separated along the perforations forming a single piece or two pieces extending from the pouch 12.

The pouch 12 may have a pair of notches 52 extending into a respective one of the lateral sides 18 of the pouch 12. Each notch 52 is configured to facilitate tearing of the pouch 12 between the closure 38 and the upper edge 30 for removal of the upper edge 30 to expose the opening 34.

Indicia 54 may be positioned on the pouch 12. The indicia 54 may be related to an occasion or event such as an anniversary, birthday, holiday, or any occasion when it may be common to purchase flowers as a gift or decorative display.

In an embodiment shown in FIGS. 1 through 6, the flower hydrating transport pouch device 10 includes a pair of tabs 56. Each of the tabs 56 extends from a respective one of the lateral sides 18 of the pouch 12. Each of the tabs 56 may be triangular having a straight upper edge 58 oriented perpendicular to the respective lateral side 18 of the pouch 12. The straight upper edge 58 may also be parallel to the opening 34. Each of a pair of tab apertures 68 extends through a respective one of the tabs 56. The tether line 40 is threaded through the tab apertures 68 in the tabs 56.

Figure 7:
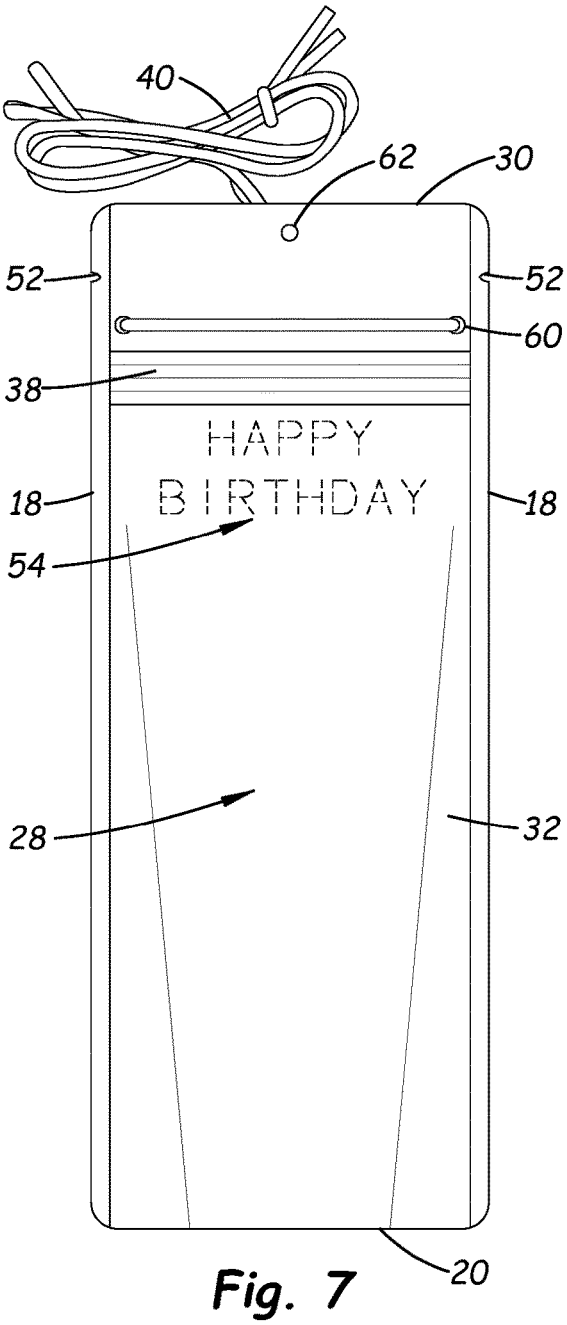
FIG. 7 is a front view of an embodiment of the disclosure.
Figure 8:
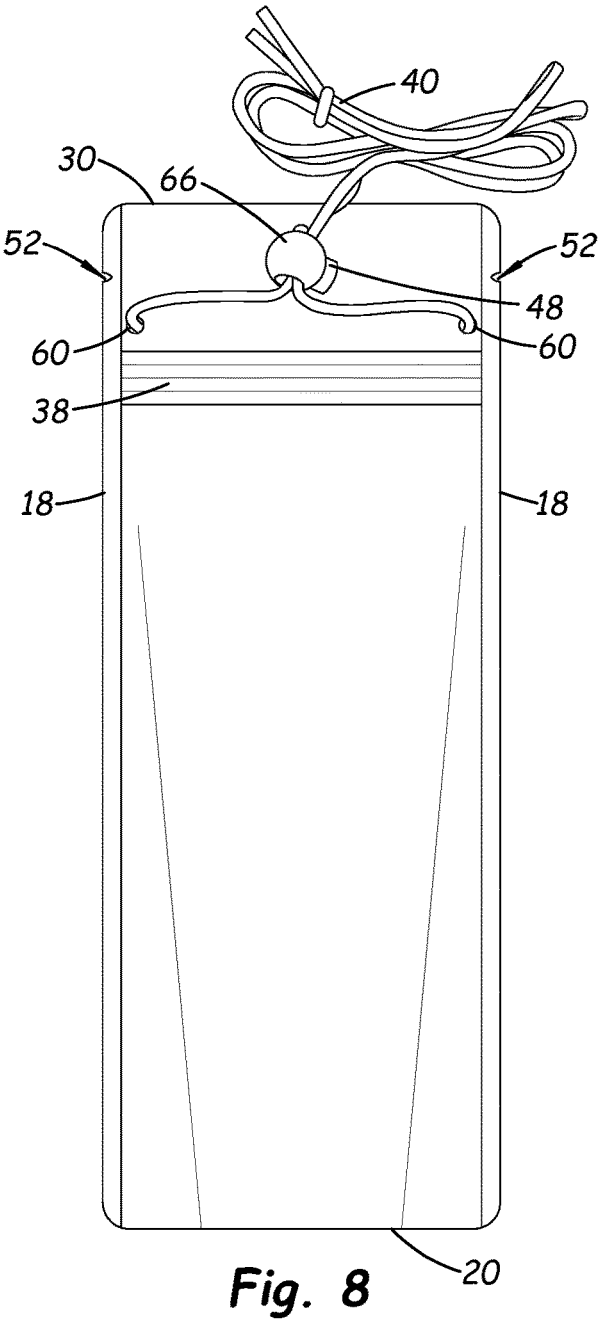
FIG. 8 is a rear view of an embodiment of the disclosure.

In an embodiment shown in FIGS. 7 and 8, the flower hydrating transport pouch device 10 includes a pair of pouch apertures 60 extending through the pouch 12. Each of the pouch apertures 60 is positioned adjacent to a respective one of the lateral sides 18 of the pouch 12 and is positioned between the closure 38 and the upper edge 30. The tether line 40 is threaded through the pouch apertures 60. Although shown in the embodiment of FIGS. 7 and 8, a display hole 62 may be provided in either embodiment extending through the pouch 12. The display hole 62 is positioned adjacent to the upper edge 30 and between the upper edge 30 and the closure 38. The display hole 62 is configured for hanging the pouch 12 on a display hook or the like at a point of sale display.

In use, the pouch 12 is made available for purchase where fresh cut flowers or flower arrangements may be purchased. The pouch 12 is opened and flowers inserted so that the hydrating fluid 36 is accessible to the fresh cut flowers or arrangement. This facilitates preservation of the flowers and prevents wilting or premature drying of the flowers during transport from the point of sale. This allows flowers to be bought and preserved at less expense than purchasing a vase and with less concern or need to rush to a destination where the flowers can be placed into a more permanent receptacle such as a vase.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A flower hydrating transport pouch device comprising:

a pouch, said pouch defining an interior space, said pouch having a pair of lateral sides;

an upper edge of said pouch being removable from a body of said pouch wherein removal of said upper edge exposes an opening into said interior space wherein said pouch is configured to receive flowers having stems inserted into said pouch;

a hydrating fluid positioned in said interior space, said hydrating fluid being a mixture of water and plant nutrients wherein said hydrating fluid is configured for hydrating the flowers having the stems inserted into said pouch;

a closure coupled to said pouch, said closure being positioned on said body of said pouch adjacent to said opening, said closure selectively closing said opening.

2. The flower hydrating transport pouch device of claim 1, further comprising:

a tether line, said tether line being coupled to said pouch, said tether line extending from said pouch such that said tether line is configured for engaging interior structure of a vehicle whereby said pouch is configured for transporting the flowers having the stems extending into said hydrating fluid within said interior space of said pouch;

a pair of tabs, each of said tabs extending from a respective one of said lateral sides of said pouch; and a pair of tab apertures, each of said tab apertures extending through a respective one of said tabs, said tether line being threaded through said tab apertures in said tabs.

3. The flower hydrating transport pouch device of claim 2, further comprising each of said tabs being triangular.

4. The flower hydrating transport pouch device of claim 3, further comprising each tab having a straight upper edge oriented perpendicular to said respective lateral side of said pouch.

5. The flower hydrating transport pouch device of claim 4, further comprising said straight upper edge being parallel to said opening.

6. The flower hydrating transport pouch device of claim 2, further comprising a toggle coupled to said tether line wherein said toggle is configured for forming said tether line into an adjustable sized loop extending from said pouch.

7. The flower hydrating transport pouch device of claim 6, further comprising said toggle having a locking element, said locking element being biased into engagement with said tether line for fixing a position of said toggle on said tether line, said locking element being manipulatable to release said locking element from said tether line for adjustment of a position of said toggle on said tether line.

8. The flower hydrating transport pouch device of claim 1, further comprising a pair of notches, each of said notches extending into a respective one of said lateral sides of said pouch wherein each notch is configured to facilitate tearing of said pouch between said closure and said upper edge for removal of said upper edge to expose said opening.

9. The flower hydrating transport pouch device of claim 1, further comprising said pouch having a bottom side, said bottom side being planar wherein said pouch is configured for standing upright on a support surface.

10. The flower hydrating transport pouch device of claim 9, further comprising said bottom side having a front edge and a rear edge, respective medial sections of said front edge and said rear edge being covexly arcuate.

11. The flower hydrating transport pouch device of claim 10, further comprising said pouch having a medial portion between said lateral sides, said medial portion extending upwardly from said medial sections of said front edge of said bottom side and said rear edge of said bottom side, said medial portion flaring outwardly extending away from said bottom side of said pouch.

12. The flower hydrating transport pouch device of claim 1, further comprising indicia positioned on said pouch, said indicia being related to an occasion or event.

13. The flower hydrating transport pouch device of claim 1, further comprising a display hole extending through said pouch, said display hole being positioned adjacent to said upper edge wherein said display hole is configured for hanging said pouch on a display hook.

14. A flower hydrating transport pouch device comprising:

a pouch, said pouch defining an interior space, said pouch having a pair of lateral sides, said pouch having a bottom side, said bottom side being planar wherein said pouch is configured for standing upright on a support surface, said bottom side having a front edge and a rear edge, respective medial sections of said front edge and said rear edge being covexly arcuate, said pouch having a medial portion between said lateral sides, said medial portion extending upwardly from said medial sections of said front edge and said rear edge, said medial portion flaring outwardly extending away from said bottom side of said pouch;

an upper edge of said pouch being removable from a body of said pouch wherein removal of said upper edge exposes an opening into said interior space;

a hydrating fluid positioned in said interior space, said hydrating fluid being a mixture of water and plant nutrients;

a closure coupled to said pouch, said closure being positioned on said body of said pouch adjacent to said opening, said closure selectively closing said opening; and a tether line, said tether line being coupled to said pouch, said tether line extending from said pouch such that said tether line is configured for engaging interior structure of a vehicle whereby said pouch is configured for transporting flowers having stems extending into said hydrating fluid within said interior space of said pouch;

a toggle coupled to said tether line wherein said toggle is configured for forming said tether line into an adjustable sized loop extending from said pouch, said toggle having a locking element, said locking element being biased into engagement with said tether line for fixing a position of said toggle on said tether line, said locking element being manipulatable to release said locking element from said tether line for adjustment of a position of said toggle on said tether line;

a pair of notches, each of said notches extending into a respective one of said lateral sides of said pouch wherein each notch is configured to facilitate tearing of said pouch between said closure and said upper edge for removal of said upper edge to expose said opening; and indicia positioned on said pouch, said indicia being related to an occasion or event.

15. The flower hydrating transport pouch device of claim 14, further comprising:

a pair of tabs, each of said tabs extending from a respective one of said lateral sides of said pouch, each of said tabs being triangular, each tab having a straight upper edge oriented perpendicular to said respective lateral side of said pouch, said straight upper edge being parallel to said opening; and a pair of tab apertures, each of said tab apertures extending through a respective one of said tabs, said tether line being threaded through said tab apertures in said tabs.

16. The flower hydrating transport pouch device of claim 14, further comprising a display hole extending through said pouch, said display hole being positioned adjacent to said upper edge wherein said display hole is configured for hanging said pouch on a display hook.

* * * * *